United States Patent [19]

Range

[11] Patent Number: 4,673,424

[45] Date of Patent: Jun. 16, 1987

[54] COMBINATION TRASH CAN AND VACUUM CLEANER ATTACHMENT

[76] Inventor: Kenneth A. Range, 4 Pine Tree Dr., Shoreview, Minn. 55112

[21] Appl. No.: 873,998

[22] Filed: Jun. 13, 1986

[51] Int. Cl.[4] ..... B01D 46/00

[52] U.S. Cl. ..... 55/356; 55/366; 55/429; 55/473; 15/352

[58] Field of Search ..... 55/366, 337, 373, 356, 55/429, 473; 15/327, 347, 352, 353; 220/1 T

[56] References Cited

U.S. PATENT DOCUMENTS

| | | | |
|---|---|---|---|
| 2,025,946 | 12/1935 | Wenner-Gren | 55/357 |
| 3,208,202 | 9/1965 | Herubel | 55/429 |
| 3,286,446 | 11/1966 | Happe et al. | 15/327 C |
| 3,618,297 | 11/1971 | Hamrick | 15/352 |

*Primary Examiner*—Bernard Nozick

*Attorney, Agent, or Firm*—Thomas B. Tate

[57] ABSTRACT

The invention is a combination trash can and vacuum cleaner attachment, comprising a rectangular container having a grocery bag contained therein, a top piece fitting over the rectangular container and having a plurality of airholes and a filter within, and a vacuum holes for attaching the device to a vacuum cleaner.

1 Claim, 2 Drawing Figures

COMBINATION TRASH CAN AND VACUUM CLEANER ATTACHMENT

SUMMARY AND BACKGROUND OF THE INVENTION

The invention is a portable trash can which can be attached to most conventional vacuum cleaners. Removing and emptying a conventional vacuum cleaner bag is a messy, time-consuming, and laborious procedure. A primary object of the present invention is to eliminate this problem by providing a container which receives the debris picked up by the vacuum cleaner and can be emptied easily for re-use. Additionally, the invention improves the suction power of a vacuum cleaner. The invention, when detached from a vacuum cleaner, can also serve the functions of a conventional trash can or wastebasket.

DESCRIPTION OF THE INVENTION

Figure 1:
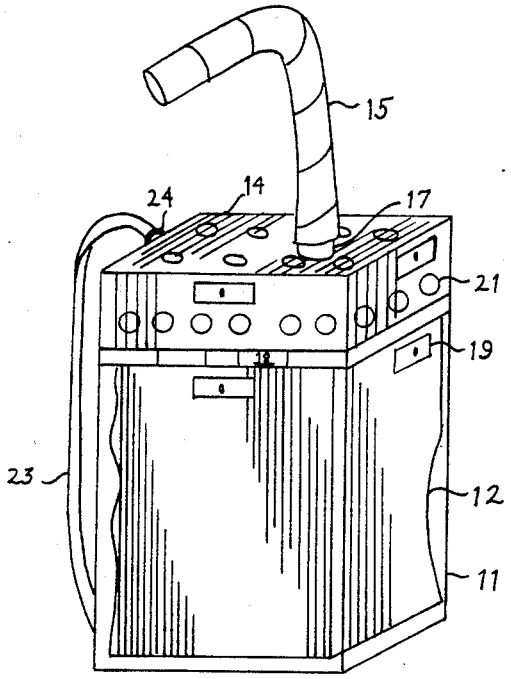
FIG. 1 is a perspective view of the front and side of the invention.
Figure 2:
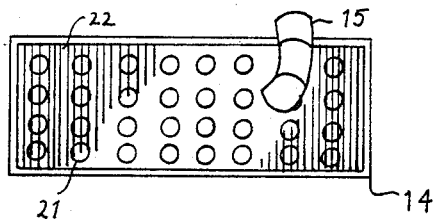
FIG. 2 is a top view.

The invention is a combination trash can and vacuum cleaner attachment.

The invention comprises a rectangular container 11, which is preferably made of injection molded plastic but which could also be made of plexiglass or other suitable materials, a grocery bag 12 which is fitted inside the container 11 so as to leave some air space between the bag 12 and the walls of the container 11, the top of the bag 12 being rolled back to fit over the top edges of the container 11, a plastic top piece 14 which fits over the top edges of the container 11 and bag 12, and a flexible hose 15 which fits over a cylindrical projection 17 on the top piece 14 and is connected at its other end to the nozzle of any conventional upright vacuum cleaner at the point where the vacuum cleaner bag is normally attached.

The top piece 14 is sealed onto the top edges of container 11 by means of a gasket 18. Attachments 19, on the top piece 14 and container 11, can be used as attachments for a clamp which would be permanently attached to attachment 19 on top piece 14 and could be pulled up to clamp into attachment 19 on container 11.

The attachments 19 are similar to the draw-catches used on fishing tackle boxes.

Top piece 14 is provided with a plurality of airholes 21 on its sides and top surface, and is also provided with a built-in filter 22 which is fit into the inside surface of top piece 14. The filter 22 can be made from an old vacuum cleaner bag or other suitable materials, and its purpose is to allow air to escape through the airholes 21. The function of the airholes 21 is to prevent the vacuum created when the vacuum cleaner is activated from blowing out the bottom of the grocery bag 12. For optimum results, there should be aporoximately twenty-eight airholes 21, but a greater or lesser number can be used.

A removeable, adjustable shoulder strap 23 attached at either end to container 11 by means of ring-like attachments 24 allows the device to be carried. As an optional feature, a ring can be placed around hose 15 to prevent it from dragging.

To use the device, the vacuum cleaner to which it is attached is turned on to full power, allowing the debris picked up by the vacuum cleaner to pass through hose 15 and enter into bag 12, which can be emptied easily for re-use.

I claim:

1. A portable trash can designed to be attached to a conventional vacuum cleaner, said device comprising:

a generally rectangular container;

a grocery bag disposed within said container, the top of said grocery bag being folded over the top edges of said container;

a generally rectangular top piece fitting over said top edges of said container, said top piece being sealed to said container by gasket means, said top piece having a plurality of airholes formed into its top and side surfaces;

filter means disposed within said top piece;

vacuum hose means attached to a cylindrical projection on said top piece, and capable of being attached at its other end to the nozzle of said conventional vacuum cleaner;

adjustable and removeable shoulder strap means attached by ring-like attachments to said container, said strap means permitting said device to be portable.

* * * * *